US008312642B2

(12) United States Patent
Bae et al.

(10) Patent No.: US 8,312,642 B2
(45) Date of Patent: Nov. 20, 2012

(54) CONTROLLING METHOD OF A STEAM GENERATOR AND A LAUNDRY MACHINE WITH THE SAME

(75) Inventors: Sang Hun Bae, Changwon-si (KR); Chang Woo Son, Changwon-si (KR); Ju Han Yoon, Changwon-si (KR)

(73) Assignee: LG Electronics Inc., Seoul (KR)

( * ) Notice: Subject to any disclaimer, the term of this patent is extended or adjusted under 35 U.S.C. 154(b) by 764 days.

(21) Appl. No.: 12/155,322

(22) Filed: Jun. 2, 2008

(65) Prior Publication Data

US 2008/0302138 A1 Dec. 11, 2008

(30) Foreign Application Priority Data

Jun. 8, 2007 (KR) ..... 10-2007-0055973
Jun. 8, 2007 (KR) ..... 10-2007-0056071

(51) Int. Cl.
*F26B 3/00* (2006.01)
*D06F 33/00* (2006.01)

(52) U.S. Cl. ..... 34/499; 8/149.3

(58) Field of Classification Search ..... 8/149.2, 8/149.3, 158; 34/380, 381, 389, 499, 595, 34/596

See application file for complete search history.

(56) References Cited

U.S. PATENT DOCUMENTS

2005/0034250 A1* 2/2005 Oh et al. ..... 8/159
2005/0034489 A1* 2/2005 Oh et al. ..... 68/5 C
2006/0191077 A1* 8/2006 Oh et al. ..... 8/158
2006/0277690 A1* 12/2006 Pyo et al. ..... 8/149.2
2007/0283509 A1* 12/2007 Wong et al. ..... 8/149.3
2008/0006300 A1* 1/2008 Ahn et al. ..... 134/18
2008/0040867 A1* 2/2008 Wong et al. ..... 8/149.3
2008/0092304 A1* 4/2008 Wong et al. ..... 8/149.3

FOREIGN PATENT DOCUMENTS

| | | | | |
|---|---|---|---|---|
| DE | 43 44 53 | C2 | | 1/1994 |
| DE | 10 2009 009 312 | A1 | | 12/2008 |
| EP | 1 507 031 | A1 | | 2/2005 |
| JP | 56009681 | A | * | 1/1981 |
| KR | 20-0211616 | | | 1/2001 |
| KR | 10-2002-0067351 | | | 8/2002 |
| KR | 10-2006-0055222 | A | | 5/2006 |
| KR | 2006-0101942 | | | 9/2006 |
| KR | 2007-0028056 | | | 3/2007 |
| KR | 10-2007-0040880 | A | | 4/2007 |
| KR | 10-2008-0003021 | | | 1/2008 |
| WO | WO 2006101376 | A1 | * | 9/2006 |
| WO | WO 2006129916 | A1 | * | 12/2006 |

* cited by examiner

*Primary Examiner* — Joseph L Perrin

(74) *Attorney, Agent, or Firm* — McKenna Long & Aldridge LLP

(57) ABSTRACT

A laundry machine having a steam generator is disclosed. A heater is controlled, such that steam generation coincides with a predetermined time period, whereby the steam supply time is enabled to be controlled with relative accuracy. If an error occurs when water is being supplied to the steam generator, then an error message is displayed such that a user may be informed of the error. If a predetermined time period has elapsed, then a pump is stopped to prevent an excessive amount of water from being supplied to the steam generator.

10 Claims, 9 Drawing Sheets

CONTROLLING METHOD OF A STEAM GENERATOR AND A LAUNDRY MACHINE WITH THE SAME

This application claims the benefit of Korean Patent Application Nos. 10-2007-0056071 and 10-2007-0055973, both filed on Jun. 8, 2007, which are hereby incorporated by reference in their entireties as if fully set forth herein.

BACKGROUND

1. Field of the Invention

The disclosure relates to a laundry machine, and more particularly, to a laundry machine having a steam generator. The laundry machine may be a clothes treating machine, such as a washing machine, a drying machine, a washing-and-drying machine, or any other similar machine.

2. Discussion of Related-Art

A washing machine may be classified as a drum type washing machine that uses lifters to lift and drop laundry in a drum to wash the laundry using a relatively small amount of water or as a pulsator type washing machine or an upright washing machine that supplies a large amount of water into a vertically installed drum and rotates the laundry to wash the laundry using friction generated by a stream of water.

A drying machine may be a home appliance that dries washed laundry using high-temperature air. Generally, the drying machine includes a drum for receiving clothes to be dried, a drive source for driving the drum, a heating unit for heating air to be introduced into the drum, and a blower unit for suctioning or discharging air into or out of the drum.

Based on how air is heated, i.e., the type of the heating unit, the drying machine may be classified as an electric drying machine or a gas drying machine. The electric drying machine typically heats air using electric resistance heaters, whereas the gas drying machine typically heats air using heat generated by the combustion of gas. In addition, the drying machine may be classified as a condensation type drying machine or an exhaust type drying machine. In the condensation type drying machine, air, heat-exchanged with clothes to be dried in a drum and changed into a high-humidity phase, is circulated without discharging the air out of the drying machine. Heat exchange is performed between an additional condenser and external air to produce condensed water, which is discharged out of the drying machine. In the exhaust type drying machine, air, heat-exchanged with clothes to be dried in a drum and changed into a high-humidity phase, is directly discharged out of the drying machine. Based on how laundry is placed in the drying machine, the drying machine may be classified as a top-loading type drying machine or a front-loading type drying machine. In the top-loading type drying machine, clothes to be dried are loaded from the top of the drying machine. In the front-loading type drying machine, clothes to be dried are loaded from the front of the drying machine.

In recent years, a steam washing machine or a steam drying machine has appeared as a laundry machine using steam. As the steam is used in the laundry machine, a washing force is increased, and energy efficiency is greatly improved. Also, new functions are being added through the use of steam.

SUMMARY

Accordingly, a controlling method of a laundry machine and a laundry machine with the same that substantially obviates one or more problems due to limitations and disadvantages of the related art is highly desirable.

Advantages, objects, and features of the invention will be set forth in part in the description which follows and in part will become apparent to those having ordinary skill in the art upon examination of the following or may be learned from practice of the invention. The objectives and other advantages of the invention may be realized and attained by the exemplary structures and/or methods particularly pointed out in the written description and claims hereof as well as the appended drawings.

An embodiment of a controlling method of a laundry machine includes turning on a heater of a steam generator, and turning off the heater a first predetermined time after a temperature of the steam generator reaches a first predetermined temperature.

According to the controlling method as described above, it is possible to relatively accurately control a steam supply time for which steam is substantially supplied to laundry.

As an example, the temperature of the steam generator may be an atmospheric temperature in the steam generator or the temperature of water in the steam generator. To sense the temperature, a temperature sensor may be mounted in the steam generator.

The first predetermined temperature may be temperature at which the water in the steam generator starts to boil. For pure water, the first predetermined temperature is 100° C. under 1 atmospheric pressure.

The water in the steam generator is changed into steam after the temperature of the steam generator reaches the first predetermined temperature.

Typically, the water, which is used, is not pure, and the surrounding atmospheric pressure slightly changes depending upon time and location. For this reason, the first predetermined temperature may be set to be 100° C. or substantially around that value.

Alternatively, the first predetermined temperature may be decided using data measured during the boiling of the water in the steam generator. For example, data of temperature based on time may be obtained, during the boiling of the water in the steam generator, to measure temperature at which the water starts to boil, and the measured temperature may be set to be the first predetermined temperature. In this case, the first predetermined temperature may change whenever the steam generator is operated, and therefore, it is possible to set the first predetermined temperature such that the first predetermined temperature is relatively correct according to given environments.

The first predetermined temperature may be set differently according the selected course. The respective course may have different purposes of using steam, and therefore, the first predetermined temperature may change depending upon the course. Of course, the respective courses may include a steam process. For example, a course may include a washing process, a steam process, a rinsing process, and a spin-drying process. The steam process may be carried out along with or separately from the other processes.

Also, the first predetermined temperature may be decided according to the amount of laundry or a user's input or a received command. As an example, for the user's input, a control panel (which has a user interface) may be provided with a button for allowing the user to input time.

The amount of laundry may be inputted by activating a laundry amount selection button. Alternatively, the amount of laundry may be sensed by a laundry amount sensor mounted in the laundry machine.

When the water level of the steam generator becomes less than a predetermined water level before the lapse of the first predetermined time, it may be necessary to supply additional water to the steam generator.

In a structure in which the steam generator is connected to a faucet via a valve, the valve may be opened to supply more water to the steam generator.

In a structure in which a pump is provided to pump water into or out of the steam generator, the pump may be operated to supply water to the steam generator. In this case, a water tank for storing water is also provided, and the pump may be operated to supply the water from the water tank to the steam generator.

The additional supply of water may be repeatedly carried out at predetermined time intervals. For example, the pump may be alternately started and stopped at predetermined time intervals.

With the additional supply of water, as described above, the temperature of the steam generator drops, with the result that the supply of steam to the laundry may be temporarily interrupted. When the steam supply interruption time increases, the steam effect is weakened, and energy efficiency is lowered. For this reason, it is necessary to control the steam supply interruption time to be as short as possible. This may be achieved by supplying a relatively small amount of water several times to the steam generator.

When the additional supply of water is repeatedly carried out several times, the stop time of the pump may be longer than the operation time of the pump. This is because relatively more time may be necessary to change the additional supplied water into steam.

Meanwhile, whether the supply of water is properly carried out according to the operation of the pump may be determined using a current level of the pump.

For example, the current of the pump may be converted into voltage, which is used to determine whether the supply of water is being properly carried out or not. For example, information relating to whether the supply of water is properly carried out may be determined when the converted voltage value is less than a first predetermined value, when the converted voltage value is between the first predetermined value and a second predetermined value, and when the converted voltage value is greater than the second predetermined value. When the current value is less than the first predetermined value, it may be determined that the amount of water to be pumped out is insufficient, and/or the pump is idle. When the current value is between the first predetermined value and the second predetermined value, it may be determined that the supply of water is properly carried out. When the current value is greater than the second predetermined value, it may be determined that a flow channel is clogged.

When the supply of water is not being properly carried out, then the pump should be stopped. For example, when there is an insufficient amount of water, as in the above example, then a message is displayed to indicate that there is an insufficient amount of water.

After it is determined that the supply of water is not normally carried out, and the pump is stopped, the pump may be restarted upon receiving an appropriate command. For example, when a problem associated with a shortage of water is resolved, the controller may receive a command to resume the supply of water (for example, the user may input the command by pushing a 'start' button), and then the pump is restarted.

When the laundry machine does not receive any input or commands for a predetermined time period, then a state of steam supply interruption may be switched to a state of steam supply completion. In this case, the course in progress may be continued to the end.

Meanwhile, when the heater malfunctions, for example, when the heat emitting efficiency of the heater is lowered, the temperature of the steam generator may drop even during the operation of the heater. In consideration of a heater error condition like this, the heater of the steam generator may be turned off when the temperature of the steam generator becomes less than a second predetermined temperature after the temperature of the steam generator reaches the first predetermined temperature. The second predetermined temperature may be set to an appropriate value in consideration of a fact that the temperature of the steam generator may drop due to the water supplied at the additional water supplying step. When the heater is turned off, then an error message, indicating a heater malfunction, may be displayed such that the user is informed of the error message.

A heater malfunction may occur when the temperature of the steam generator does not reach the first predetermined temperature even a predetermined time after the heater of the steam generator is started. Therefore, when a second predetermined time lapses before the temperature of the steam generator reaches the first predetermined temperature, the heater may be stopped. At this time, an error message, indicating a heater malfunction, may be displayed via the display.

Hereinafter, an embodiment of a controlling method of supplying water to the steam generator using the pump will be described.

The controlling method according to this embodiment may include starting a pump to supply water to a steam generator, determining whether the water level of the steam generator is a predetermined water level, and stopping the pump when it is determined that the water level of the steam generator is the predetermined water level.

Until the water level of the steam generator reaches the predetermined water level, the pump is operated to supply water to the steam generator. The water level of the steam generator may be sensed, for example, by a water level sensor mounted in the steam generator.

The pump is operated until the water level of the steam generator reaches the predetermined water level. However, when there is an error in determining the predetermined water level, an excessive amount of water may be supplied to the steam generator. For example, when the water level sensor malfunctions or when the sensing of the water level is not correctly carried out (for example, when water shakes in the steam generator, it is difficult to sense the water level of the steam generator), water may be excessively supplied to the steam generator. Consequently, it is necessary to devise a means for preventing the excessive supply of water. To this end, the pump may be controlled to be stopped when the operation time of the pump reaches a predetermined time.

The controlling method may include displaying an error message on a display when the predetermined time passes and the water level of the steam generator does not reach the predetermined water level. For example, when the operation of the pump is abnormal or when the flow channel is abnormal, water may not be smoothly supplied to the steam generator although the pump is operated for a predetermined time. In this case, it is necessary to provide notification that there is an error.

Here, as previously described, whether the supply of water is properly carried out according to the operation of the pump may be determined using a current level of the pump.

At this time, if no countermeasures are taken during a predetermined time period after a message indicating that there is an insufficient amount of water, then an error message may be generated and/or displayed, and the controller 600 may stop other components of the laundry machine (for example, a motor for driving a drum).

It is to be understood that both the foregoing general description and the following detailed description are exemplary and explanatory and should not be construed as limiting the scope of any claim.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the invention. In the drawings.

DETAILED DESCRIPTION OF THE ILLUSTRATED EMBODIMENTS

Reference will now be made in detail to exemplary embodiments of the invention, which are illustrated in the accompanying drawings. Wherever possible, the same reference numbers will be used throughout the drawings to refer to the same or like parts.

Figure 1:
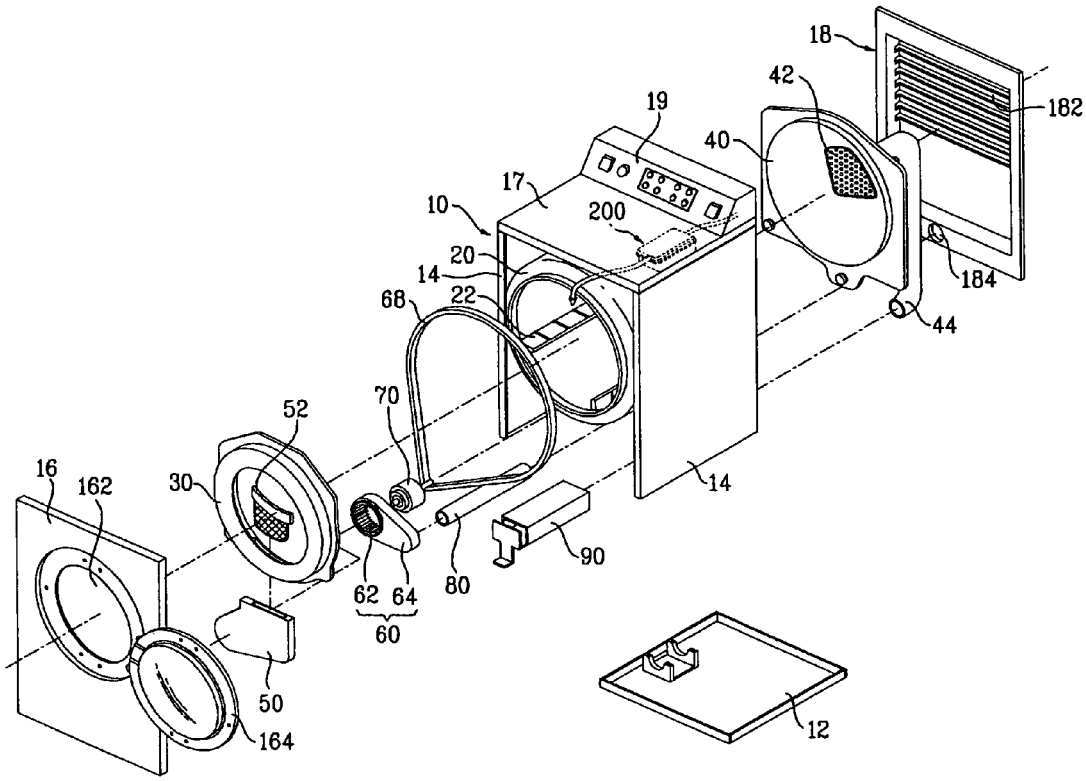
FIG. 1 is an exploded perspective view illustrating a drying machine.
Figure 2:
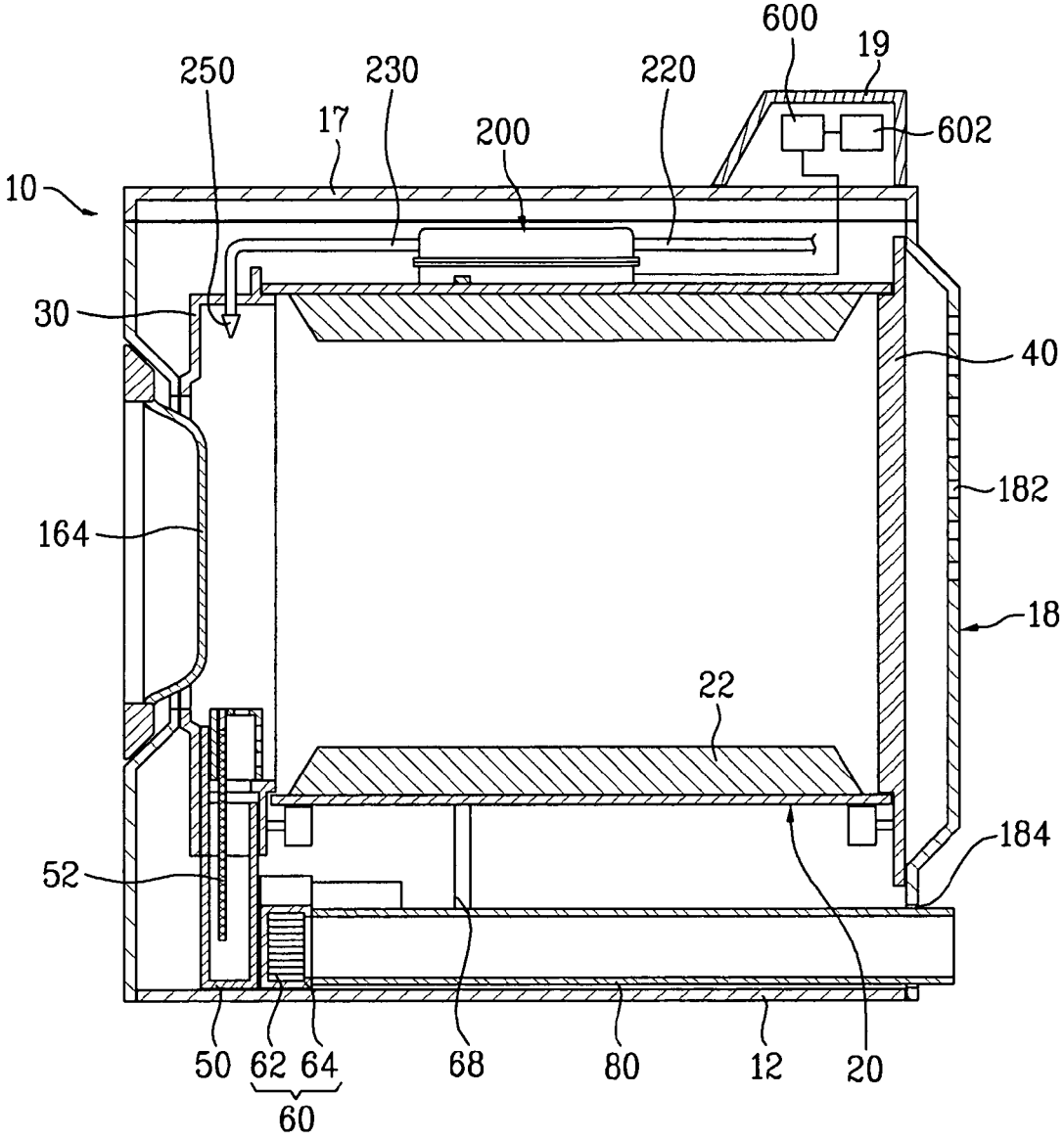
FIG. 2 is a sectional view of the drying machine.

FIGS. 1 and 2 illustrate a drying machine having a steam generator.

A cabinet 10 defines an exterior of the drying machine. A rotary drum 20, and a motor 70 and a belt 68 for driving the drum 20 are mounted in the cabinet. At predetermined positions, in the cabinet 10, are mounted a heater 90 (hereinafter, referred to as a "hot air heater" for convenience of description) for heating air to generate high-temperature air (hereinafter, referred to as "hot air"), and a hot air supply duct 44 for directing hot air, generated by the hot air heater 90, into the drum 20. In the cabinet 10 are also mounted an exhaust duct 80 for discharging high-humidity air, heat-exchanged with an object to be dried in the drum 20, out of the drying machine, and a blower unit 60 for suctioning the high-humidity air. In addition, a steam generator 200, for generating high-temperature steam, is mounted at a predetermined position in the cabinet 10. In this embodiment, an indirect drive system, in which the drum 20 is rotated using the motor 70 and the belt 68, is illustrated and described for convenience of description. However, this disclosure is not limited to the indirect drive system. For example, this disclosure may be applied to a direct drive system in which the motor is directly connected to the rear of the drum 20 such that the drum 20 is directly rotated by the motor.

Now, the respective components of the drying machine will be described in detail.

The cabinet 10 defines the exterior of the drying machine. The cabinet 10 includes a base 12 constituting the bottom thereof, a pair of side covers 14 mounted vertically on respective sides of the base 12, a front cover 16 and a rear cover 18 mounted at the front and rear of the side covers 14, respectively, and a top cover 17 located at the top of the side covers 14. A control panel 19, having various manipulation switches, is normally disposed at the top cover 17 or the front cover 16. The front cover 16 includes an opening 162. A door 164 is mounted to the front cover 16. The rear cover 18 is provided with a suction unit 182, through which external air is introduced, and an exhaust hole 184, which is a final channel for discharging the interior air of the drum 20 outside.

The interior space of the drum 20 serves as a drying chamber in which a drying process is carried out. Inside the drum 20 are preferably mounted lifts 22 for lifting and dropping clothes to be dried, such that the clothes turn over, to increase drying efficiency.

A front supporter 30 and a rear supporter 40 are mounted between the drum 20 and the cabinet 10, i.e., between the drum 20 and the front cover 16 and between the drum 20 and the rear cover 18, respectively. The drum 20 is rotatably mounted between the front supporter 30 and the rear supporter 40. Between the front supporter 30 and the drum 20 and between the rear supporter 40 and the drum 20 are mounted sealing members (not shown) for preventing the leakage of air, respectively. Specifically, the front supporter 30 and the rear supporter 40 enclose the front and the rear of the drum 20 to define the drying chamber. Also, the front supporter 30 and the rear supporter 40 serve to support the front end and the rear end of the drum 20, respectively.

In the front supporter 30 is formed an opening, through which the drum 20 communicates with the outside of the drying machine. The opening is selectively opened and closed by the door 164. A lint duct 50, which is a channel for discharging the interior air of the drum 20 outside, is connected to the front supporter 30. A lint filter 52 may be mounted in the lint duct 50. One side of the blower unit 60 is connected to the lint duct 50, and the other side of the blower unit 60 is connected to the exhaust duct 80. The exhaust duct 80 communicates with the exhaust hole 184, which is formed in the rear cover 18. When the blower unit 60 is operated, the interior air of the drum 20 is discharged outside through the lint duct 50, the exhaust duct 80, and the exhaust hole 184. At this time, foreign matter, such as lint, may be filtered out by the lint filter 52. Generally, the blower unit 60 includes a blower 62 and a blower housing 64. The blower 62 is generally connected to the motor 70, which drives the drum 20. Consequently, the blower unit 60 and the drum 20 are simultaneously driven during the operation of the motor 70. Of course, the blower unit 60 and the drum 20 may be constructed to be separately driven. If this is the case, then two motors may be connected to the blower unit 60 and the drum 20, respectively.

The rear supporter 40 includes an opening 42 and a plurality of through-holes. The hot air supply duct 44 is connected to the opening 42. The hot air supply duct 44, communicating with the drum 20, serves as a channel for supplying hot air into the drum 20. The hot air heater 90 is mounted at a predetermined position on the hot air supply duct 44.

The steam generator 200, for generating steam to be supplied into the drum 20, is mounted at a predetermined position within the cabinet 10. The details of the steam generator 200 will be described below with reference to FIG. 3.

The steam generator 200 includes a container 210 for storing water, a heater 240 mounted in the container 210, a water level sensor 260 for sensing the water level in the steam generator 200, and a temperature sensor 270 for sensing the temperature in the steam generator 200. The water level sensor 260 generally includes a common electrode 262, a low water level electrode 264, and a high water level electrode 266. The water level sensor 260 senses a high water level or a low water level in the steam generator 200 based on the electrical current conduction between the common electrode 262 and the high water level electrode 264 or the electrical current conduction between the common electrode 262 and the low water level electrode 266.

A water supply hose 220 may be connected to one side of the steam generator 200. The water supply hose 220 supplies water to container 210. To the other side of the steam generator 200 is connected a steam hose 230 for discharging steam. At the tip end of the steam hose 230 is preferably mounted a nozzle 250, which is formed in a predetermined shape. Generally, one end of the water supply hose 220 is connected to an external water supply source, such as a faucet (not shown). The tip end of the steam hose 230 or the nozzle 250, i.e., the steam discharge port, is located at a predetermined position in the drum 20 for spraying steam into the drum 20.

Figure 4:
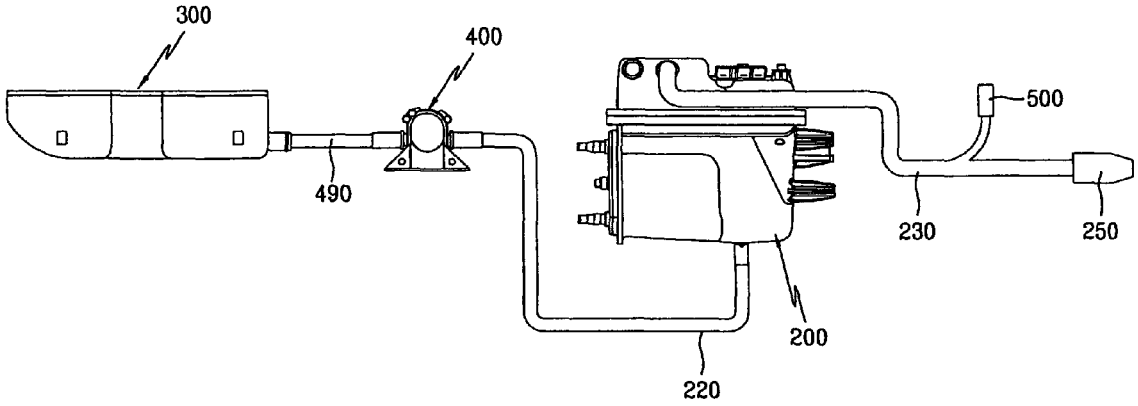
FIG. 4 is a view illustrating another embodiment of a drying machine.

Now, another embodiment of a drying machine according to the present invention will be described with reference to FIG. 4.

In this embodiment, the water supply source, for supplying water to the steam generator 200, is a detachable water tank 300. The water supply source may be a faucet (not shown). In this case, however, the installation of the water supply source may be complicated. This is because water is not generally used in the drying machine, and therefore, when the faucet is used as the water supply source, it may be necessary to install various devices, which are annexed to the faucet. In this embodiment, therefore, the detachable water tank 300 may be used. Specifically, the water tank 300 is separable from the steam generator 200, but is used to fill the steam generator 200 with water. After the water tank 300 is filled with the water, the water tank 300 is connected to the steam generator via a water supply channel 490, the pump 400, and the water supply hose 220. The detachable water tank 300 may be convenient, however, the water tank 300 is not limited to being detachably mounted to the drying machine. For example, the water tank 300 may be fixedly mounted to the drying machine. Also, it is possible to use another water supply source, such as a faucet, instead of the water tank.

Between the water tank 300 and the steam generator 200 is preferably mounted a pump 400. The pump 400 is preferably rotatable in the clockwise (CW) and counterclockwise (CCW) directions. Consequently, it is possible to supply water to the steam generator 200 by, for example, rotating the pump 400 in a clockwise (CW) direction, and, if necessary, it is possible to withdraw or drain water remaining in the steam generator 200 by, for example, rotating the pump 400 in a counter-clockwise (CCW) direction.

Figure 10:
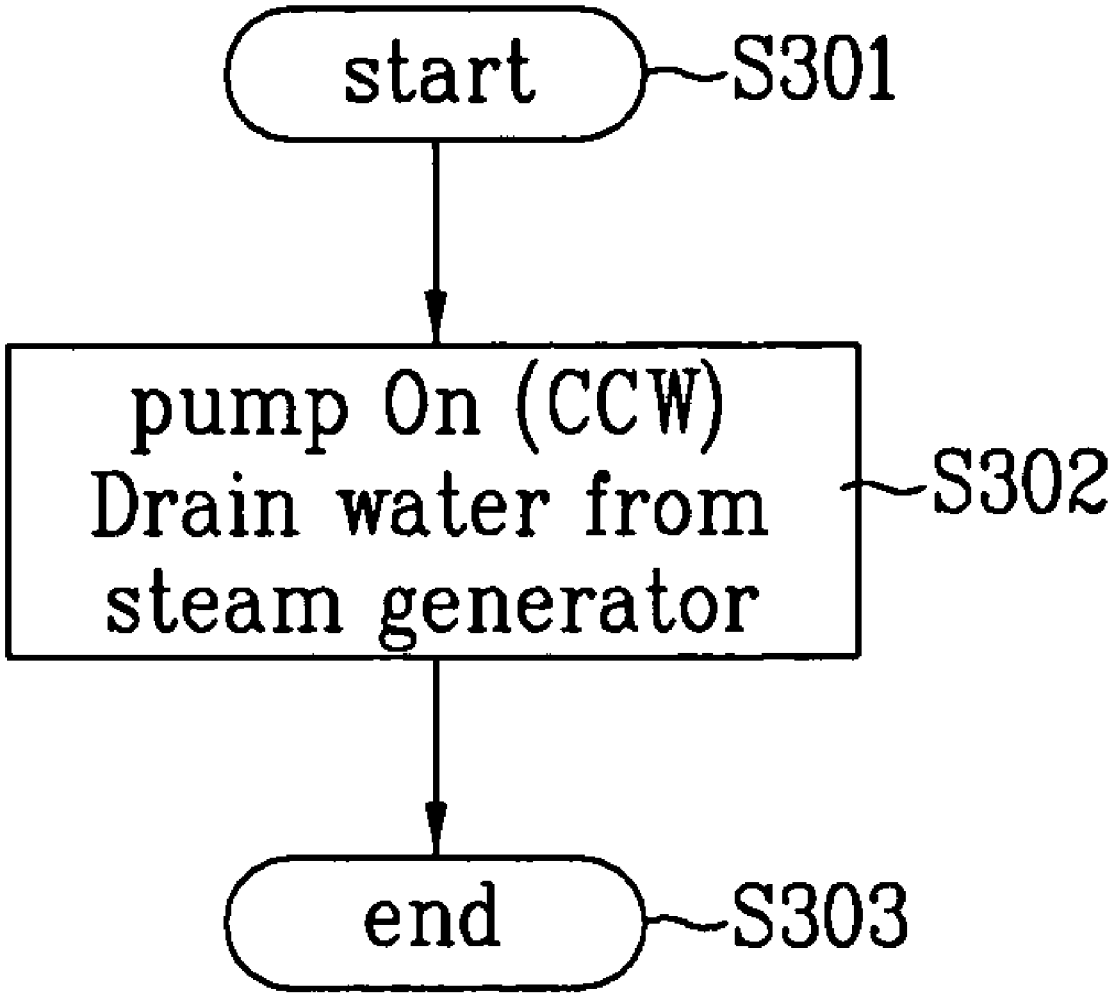
FIG. 10 is a flow chart illustrating an exemplary method of draining water from the steam generator by a pump.

FIG. 10 illustrates a method of draining water from the steam generator. As illustrated, the method may begin at S301. At S302, the pump 400 may be actuated to withdraw or drain water from the steam generator 200. In one embodiment, as described above, the pump 400 may be rotated in the counterclockwise (CCW) direction when the pump is turned on. Conversely, in the same embodiment, to supply water to the steam generator 200, the pump 400 may be rotated in the clockwise (CW) direction when the pump is turned on.

Alternatively, it is also possible to supply water to the steam generator 200 using a height differential between the water tank 300 and the steam generator 200, without using the pump 400. However, various components of the drying machine are normally standardized articles and designed in a compact structure, with the result that the structurally available space of the drying machine may be insufficient. For this reason, the water supply using a height difference between the water tank 300 and the steam generator 200 may necessitate a change of the size of various components of the conventional drying machine. Consequently, when a relatively small-sized pump is used, it is possible to install the steam generator 200 without the change in size of various components of the conventional drying machine, and therefore, the use of the pump is beneficial. Examples of the benefit of draining the remaining water from the steam generator 200 are that the heater (not shown; similar to 240 of FIG. 3) may be damaged due to leaving the remaining water in the steam generator 200, or a user may unintentionally use stale water, if the steam generator 200 is not used for a long period of time.

Figure 3:
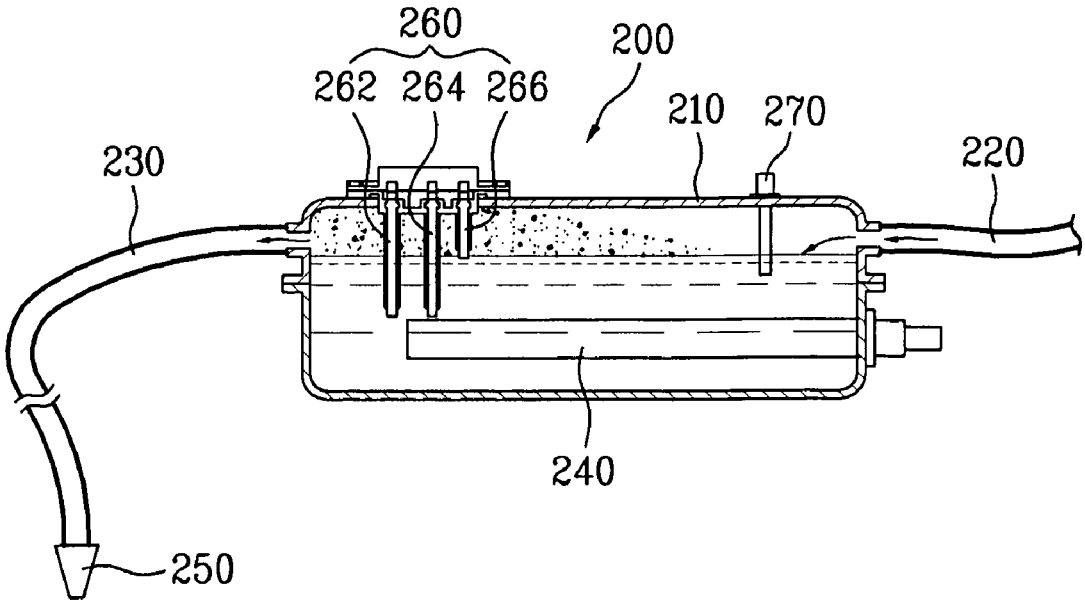
FIG. 3 is a view illustrating a steam generator used in the drying machine 2.

In FIG. 3, water is supplied into the upper part of the steam generator 200, and steam is discharged from the upper part of the steam generator 200. In the embodiment of FIG. 4, water is supplied into the lower part of the steam generator 200, and steam is discharged from the upper part of the steam generator 200. The structure of FIG. 4 may be advantageous in draining the remaining water from the steam generator 200.

Also, a safety valve 500 may be mounted on a steam channel for discharging steam from the steam generator 200 via a steam hose 230, if, for example, the pressure in the steam generator 200 exceeds a predetermined value.

Meanwhile, the drying machine further includes a controller 600 and associated memory 602. Memory 602 stores instructions, which, when executed by the controller 600, controls the heater of the steam generator 200 according to a controlling method as shown, for example, in FIGS. 5 and 6.

Figure 5:
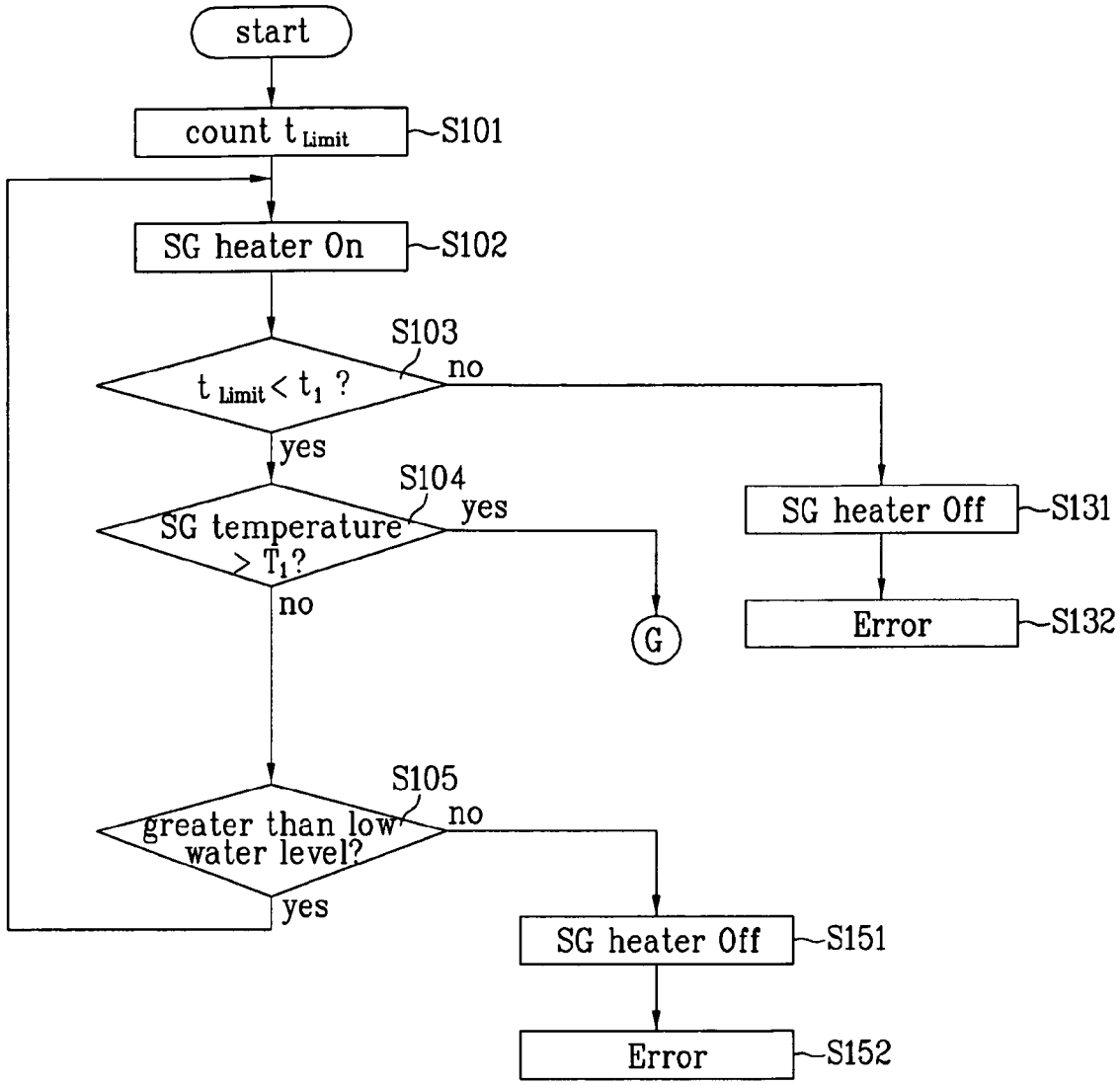
FIGS. 5 and 6 are flow charts illustrating a method of controlling a heater of a steam generator.

Referring to FIG. 5, at S101 the operation time of the heater is initialized to $t_{Limit}$ and counting begins. The heater 240 is turned on and begins to heat water in the steam generator 200 (S102). The interior water of the steam generator (200) is heated by the heater 240 until the interior water of the steam generator (identified as "SG temperature" in FIG. 5) reaches a first predetermined temperature $T_1$ (for example, 100° C. for pure water). During this process, the water temperature of the steam generator 200 is being checked (S104).

The operation time of the heater 240 is counted (S101). When the counted time $t_{Limit}$ reaches a predetermined time $t_1$ before the temperature of the steam generator 200 reaches or exceeds the first predetermined temperature $T_1$ (S103), then the heater 240 is stopped (S131), and an error is displayed on a display (S132). If the temperature of the steam generator 200 does not increase to the predetermined temperature although the water is heated for the predetermined time, it may mean that there is a heater 240 malfunction, and therefore, the heat generation efficiency of the heater 240 is greatly lowered.

On the other hand, when the water level of the steam generator 200 becomes lower than a predetermined low water level while the water in the steam generator 200 is continuously heated (S105), then this event may indicate that there is water leakage. Consequently, the heater 240 is turned off (S151), and an error is displayed (S152).

Figure 6:
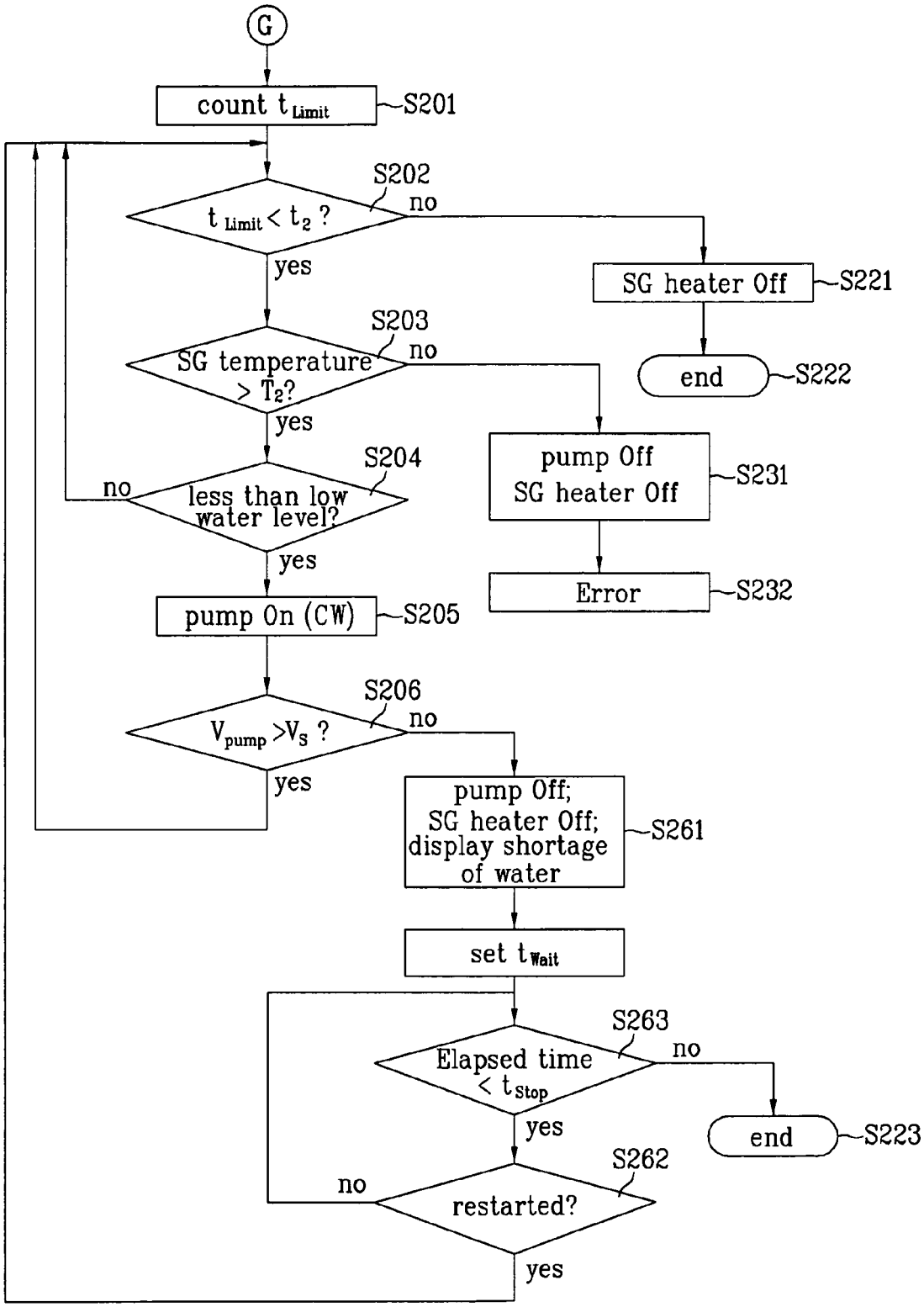

When the steam generator 200 is operating properly, and therefore, the interior temperature of the steam generator 200 reaches the first predetermined temperature $T_1$ (S1104), the heater 240 is maintained on, and time is reinitialized and recounted (S201) (FIG. 6).

When the reinitialized counted time $t_{Limit}$ reaches a second predetermined time $t_2$ (S202), the heater 240 is turned off (S221), and the steam process is ended (S222). Consequently, steam is supplied to laundry for a duration of at least a period of time corresponding to the second predetermined time $t_2$.

However, if the interior temperature of the steam generator 200 becomes less than a second predetermined temperature $T_2$, before the lapse of the second predetermined time $t_2$ (S203), then this may indicate that the heater 240 has malfunctioned, the heater 240 and pump 400 (if present) are turned off (S231), and an error is displayed (S232). The second predetermined temperature $T_2$ is a value set considering, for example, at least the additional supply of water, which will be described in the following.

When it is determined that the water level of the steam generator 200 is less than the predetermined low water level, while the heater 240 is maintained on to generate steam (S204), the pump 400 is operated to supply water to the steam generator 200 (S205). The pump 400 may be repeatedly turned on/off at predetermined time intervals.

During the operation of the pump 400, the pump 400 is controlled to be turned on/off according to an electrical current value of the pump 400.

Figure 7:
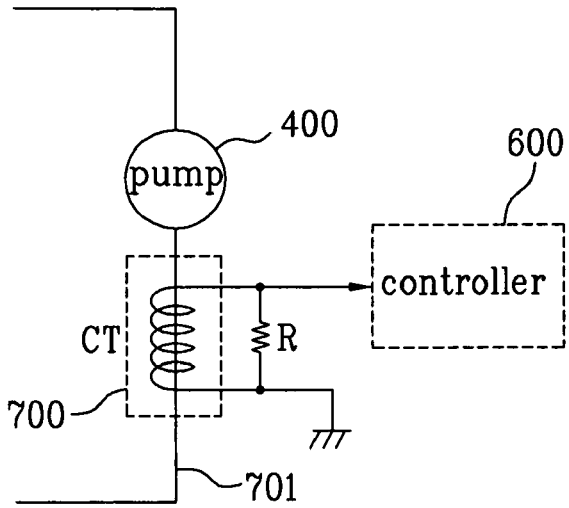
FIG. 7 is a circuit diagram for detecting an electrical current level of a pump.
Figure 8:
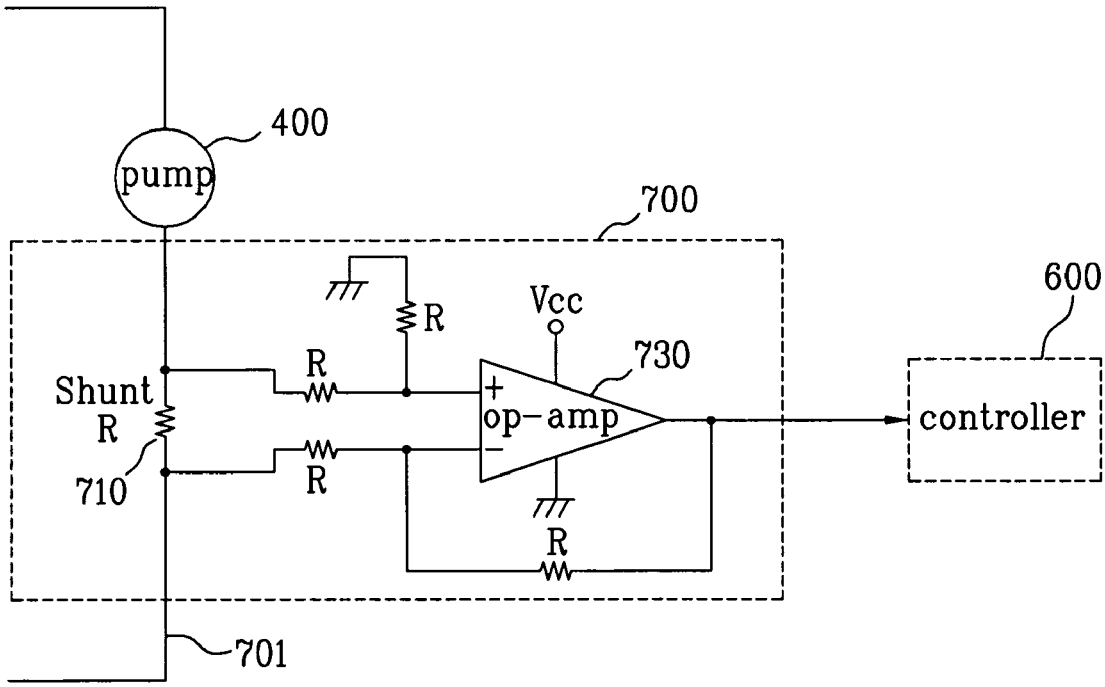
FIG. 8 is a circuit diagram for detecting an electrical current level of a pump according to another example.

A detecting unit for detecting the value of electrical current drawn by the pump 400 may be realized, for example, by a sensor 700, such as a current transducer (CT) (FIG. 7) or a circuit using shunt resistance 710 (FIG. 8).

First, as shown in FIG. 7, the current transducer may be installed at one end of the pump 400, and a resistance R is connected in parallel to the current transducer. In the exemplary case, as illustrated, a magnetic field is generated by electric current supplied to the pump 400 via electric supply line 701, and the current transducer outputs a voltage value proportional to the generated magnetic field. The resistance R, for voltage division, is preferably connected in parallel to the current transducer such that the voltage output from the current transducer is lowered to a voltage level recognizable by the controller 600 (FIG. 4).

When the pump 400 uses an alternating current (AC) motor, it is possible to use the current transducer. The current transducer does not affect a rotational torque of the pump 400, and the current transducer is not affected by noise because an output end of the current transducer is isolated.

On the other hand, as shown in FIG. 8, the sensor 700 may include an operational amplifier (op-amp) 730 for amplifying the output of a shunt resistance 710, which is connected in series with the electric supply line 701 of the pump 400. In this case, the resistance 710 is shunted across the inputs of the op-amp 730 and the op-amp 730 outputs a voltage value corresponding to a current level supplied to the pump 400. The voltage across the shunt resistance 710 is amplified by the operational amplifier 730, and the amplified voltage may be transmitted to the controller 600.

The components of sensor 700 as depicted in FIG. 8, including the operational amplifier 730, constitute a differential amplifier, which amplifies and outputs the voltage difference between opposite ends of the shunt resistance 710 to a level recognizable by the controller 600.

Here, the sensor 700, using the shunt resistance 710, is applicable when the pump 400 uses a direct current (DC) motor. The sensor 700 is constructed in a circuit structure unlike the current transducer (CT of FIG. 7), and therefore, costs are reduced, and the defect rate is also low.

In the aforementioned embodiments of the sensor 700, the controller 600 determines the electrical current level of the pump 400 from the voltage value detected as described above. For example, a table of electrical current based on voltage may be prepared through repetitive tests under the same condition. The prepared table may be stored in a memory, such as memory 602. An electrical current level corresponding to a voltage value may be read from the stored table, and the read current level may be recognized as the electrical current level of the pump 400.

When the pump 400 is operating properly, and therefore, the supply of water is also properly carried out, the current of the pump 400 has a predetermined value or a value within a predetermined range. However, when the supply of water is not properly carried out, the current of the pump 400 may deviate from the predetermined value or the value within the predetermined range.

The controller 600 compares a voltage value, $V_{pump}$, converted from the electrical current of the pump 400 as described above with a predetermined value Vs (S206) (FIG. 6). When the voltage value $V_{pump}$ exceeds the predetermined value Vs, it is determined that the supply of water is properly being carried out, and therefore, the pump 400 is maintained on.

On the other hand, when the voltage value $V_{pump}$ is less than the predetermined value Vs, both the pump 400 and the heater 240 of the steam generator 200 may be turned off at S261. A message may be displayed to indicate that there is an insufficient amount of water at S261. A predetermined period of time, $t_{wait}$, may be set at S263. The method proceeds to S264. If the elapsed time since S263 is less than $t_{wait}$, the method proceeds to S262, where it may be determined if a restart command was received. If a restart command was received, the method returns to S202, where it is determined if $t_{Limit}<t_2$. If, at S262, a restart command is not received, then the method returns to S264, where it is again determined if the elapsed time since S263 less than $t_{wait}$. If the elapsed time since S263 less than $t_{wait}$, i.e., a predetermined period of time defined as $t_{wait}$ has expired, then the method proceeds to S223 where the method may end.

A voltage value $V_{pump}$ that is less than the predetermined value Vs may mean that the electrical current level of the pump 400 is less than a predetermined value. The voltage value $V_{pump}$ is less than the predetermined value Vs, for example, when the water tank 300 contains no water, or when the detachable water tank 300 is not properly connected to the water supply hose. In this case, a message indicating that there is an insufficient amount of water or a message indicating that the installation of the water tank 300 is to be checked may be displayed via a display (not shown), and the pump 400 and heater 240 are maintained in an off state for a predetermined time. In other words, when a user does not take action to restart the steam generator operation even after the lapse of the predetermined time, the steam process is ended, and the next process is commenced to complete the selected course.

On the other hand, when the controller 600 receives a certain signal, for example, when the controller 600 senses the actuation of a 'start' button, then the controller 600 restarts the pump 400 and heater 240, which have been maintained in an off state (S262). When the user is informed of a message that water is insufficient or the water tank 300 is not properly installed, the user may replenish the water tank 300 with water or take an appropriate step to properly install the water tank 300, and then press the 'start' button. As a result, the pump 400 and heater 240 are restarted (S262).

Although not shown, the control panel 19 has a laundry amount selection button for allowing a user to input the amount of laundry. Consequently, when the user selects the amount of laundry, the second predetermined time $t_2$ may be decided according to the selected amount of laundry. Alternatively, the control panel 19 may include an input button for allowing a user to input steam supply time (i.e., the second predetermined time, $t_2$) for which steam is supplied to the laundry. Consequently, when the user inputs the steam supply time, the second predetermined time $t_2$ is decided according to the inputted steam supply time.

Figure 9:
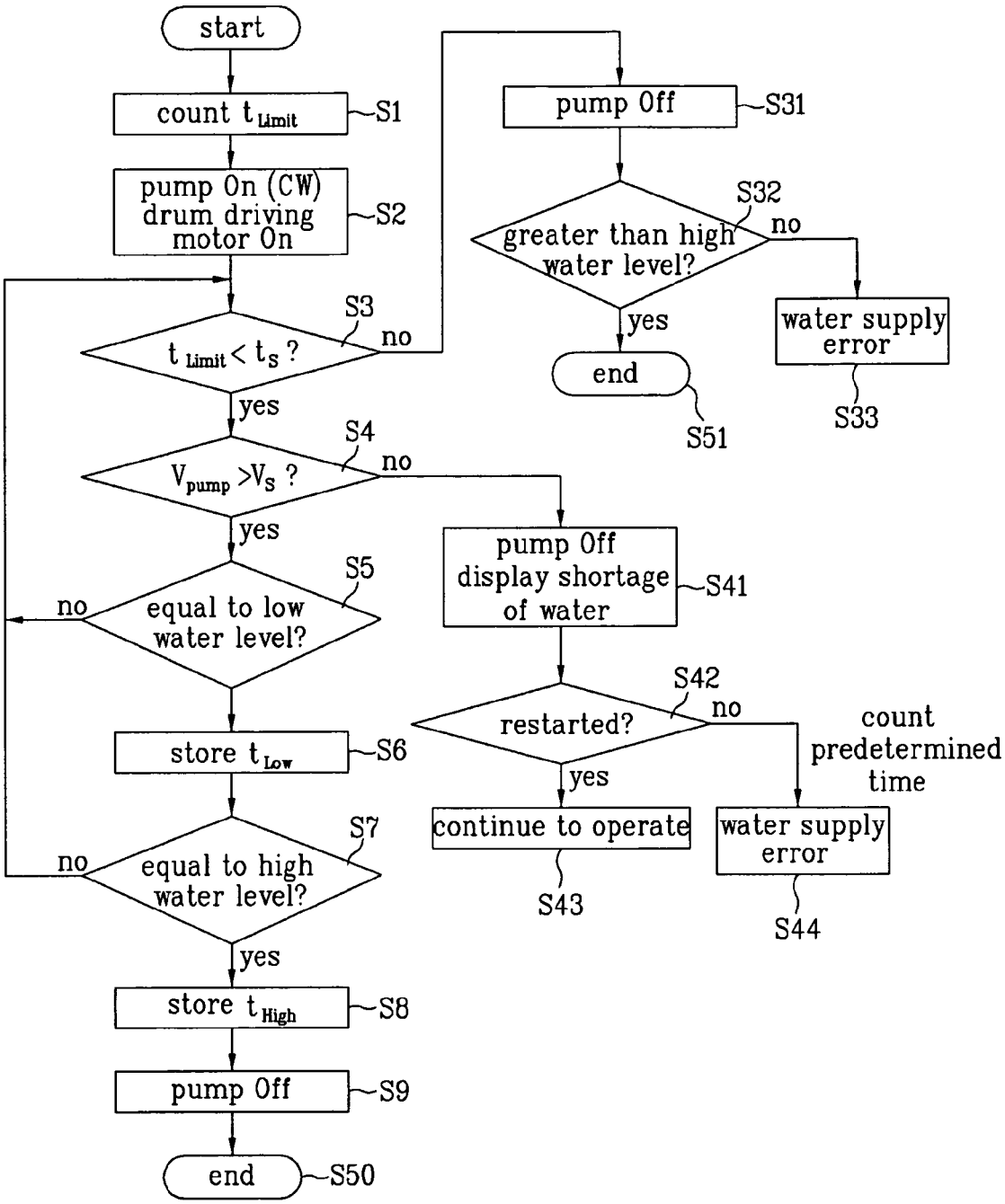
FIG. 9 is a flow chart illustrating a method of controlling the supply of water to the steam generator.

Meanwhile, the controller 600 may control the supply of water to the steam generator 200 according to a controlling method illustrated in FIG. 9.

The method includes counting, by a controller 600, time $t_{Limit}$ (S1), and turning on, by the controller 600, the pump 400 (S2). The controller 600 may also start the drum drive motor 70, to rotate the drum, at the time of turning on the pump 400 (S2). With the operation of the pump 400, water is pumped from the water tank 300 to the steam generator 200.

The controller 600 measures the amount of time it takes for the water level to reach the high water level from the low water level (hereinafter, referred to as a 'water level shift time') $t_{High}-t_{Low}$ with a predetermined range of time using a low water level arrival time $t_{Low}$ and a high water level arrival time $t_{High}$. When the water level shift time $t_{High}-t_{Low}$ is less than (e.g., filled too fast) or greater than (e.g., filled too slow) the predetermined range of time controller 600 determines that an error occurred during the supply of water. Such an error may be stored in the memory 602, for example, as history data of the drying machine and/or displayed on a display. Also, when the controller 600 determines that the degree of the error is excessive, for example, the water level shift time $t_{High}-t_{Low}$ is excessively greater than the predetermined range of time, the controller 600 may display the error on the display.

On the other hand, when the voltage value $V_{pump}$ is less than the predetermined value Vs (S4), the pump 400 is stopped (S41). When the voltage value $V_{pump}$ is less than the predetermined value Vs, a message indicating that there is in an insufficient amount of water or the installation of the water tank 300 is to be checked is displayed through the display (S41). And the pump 400 is maintained in an off state for a predetermined time period. When a particular command is not received after the lapse of a predetermined time period, an error is displayed on the display (S44).

On the other hand, when a command is received, for example, when a 'start' button is activated (S42), then the controller 600 restarts the pump 400, which has been maintained in an off state. When the user is informed of a message that the amount of water is insufficient or the water tank 300 is not properly installed, the user may replenish the water tank 300 with water or take an appropriate step to properly install the water tank 300, and the may press the 'start' button. As a result, the pump 400 is restarted (S42). The operation of the pump 400 is continued until the water level of the steam generator 200 reaches or exceeds the high water level (S7) or the operation time of the pump 400 reaches the predetermined time $t_s$ (S3).

The pump 400 is stopped when the water level of the steam generator 200 reaches or exceeds the high water level (S7); however, the pump 400 is controlled to be stopped even when the operation time of the pump 400 reaches the predetermined time $t_s$ (S3). Even when the pump 400 is stopped due to the lapse of the predetermined time $t_s$, as described above, controller 600 may determine the water level of the steam generator 200 (S32). When the water level of the steam generator 200 reaches or exceeds the high water level (S7), it is determined that the supply of water has been normally carried out, and the supply of water is ended (S9). If, however, the water level of the steam generator 200 has not reached the high water level even after lapse of the predetermined time $t_s$, then it is determined that an error occurred during the supply of water, the pump 400 is turned off (S31) and the error is displayed through the display (S33). Here, the error may include, for example, a notice concerning the reduction of the output of the pump 400, the malfunction of the water level sensor in the steam generator 200, clogging of the water supply channel 490, 220 and etc.

After the water supplying process is completed (S50, S51), then the heater 240 of the steam generator 200 may begin to heat the water in the steam generator to generate steam, for example, according to the method of FIGS. 5 and 6.

In the above, examples were described on the assumption that the laundry machine is a drying machine. However, the laundry machine may be a washing machine or a washing-and-drying machine.

It will be apparent to those skilled in the art that various modifications and variations can be made in the embodiments disclosed herein without departing from the spirit or scope of the inventions. Thus, it is intended that the present invention covers the modifications and variations of these embodiments provided they come within the scope of the appended claims and their equivalents.

What is claimed is:

1. A controlling method of a dryer configured to supply hot air to dry laundry, the controlling method comprising:

turning on a pump to supply water to a steam generator, the pump being in the dryer;

sensing a water level of the steam generator by a water level sensor; and turning off the pump, wherein a controller is configured to turn the pump off in the turning off step a predetermined time period after turning on the pump to avoid excess filling when the sensor does not sense a predetermined level to turn off the pump until the predetermined time period or to turn the pump off in the turning off step based on a comparison of an electrical current level of the pump to a predetermined value, and wherein even when the pump is turned off due to the lapse of the predetermined time period, the water level sensor continues to sense the water level of the steam generator.

2. The controlling method of claim 1, further comprising:

displaying a message when the predetermined time period elapses and the sensed water level does not reach the predetermined level.

3. The controlling method of claim 1, further comprising:

displaying a message indicating an amount of water is insufficient upon turning off the pump based on the comparison.

4. The controlling method of claim 1, further comprising:

turning on the pump upon receiving a command, wherein the pump has been in an off state.

5. The controlling method of claim 4, further comprising:

displaying a message when the command is not received until after a predetermined time period elapses, wherein the pump is in an off state.

6. The method of claim 1, further comprising:

turning on the pump to drain water from the steam generator.

7. The method of claim 1, further comprising:

turning on a heater of a steam generator for a steam process; and turning off the heater at a predetermined time after a temperature of water in the steam generator reaches a first predetermined temperature.

8. The method of claim 7, further comprising:

turning on the pump to drain water from the steam generator.

9. A controlling method of a dryer configured to supply hot air to dry laundry, the controlling method comprising:

turning on a pump to supply water to a steam generator, the pump being in the dryer;

sensing a water level of the steam generator by a water level sensor; and turning off the pump, wherein a controller is configured to turn the pump off within a predetermined time period after turning on the pump in the turning off step at least based on a comparison of an electrical current level of the pump to a predetermined value and a sensed water level, and wherein even when the pump is turned off due to the lapse of the predetermined time period, the water level sensor continues to sense the water level of the steam generator.

10. The laundry machine of claim 9, wherein the pump is turned off after the predetermined time period in the turning off step when the pump is not turned off within the predetermined time period.

* * * * *